US006674254B2

(12) United States Patent
Hanna et al.

(10) Patent No.: US 6,674,254 B2
(45) Date of Patent: Jan. 6, 2004

(54) METHOD AND APPARATUS FOR TUNING PARTICLE ACCELERATORS

(75) Inventors: Samy M. Hanna, Danville, CA (US); Kenneth Whitman, Alamo, CA (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 297 days.

(21) Appl. No.: 09/929,803

(22) Filed: Aug. 13, 2001

(65) Prior Publication Data

US 2003/0030391 A1 Feb. 13, 2003

(51) Int. Cl.[7] ..... H05H 9/00

(52) U.S. Cl. ..... 315/505; 315/500; 250/505.1; 250/492.3

(58) Field of Search ..... 715/505, 500; 250/505.1, 442.3

(56) References Cited

U.S. PATENT DOCUMENTS 4,629,938 A * 12/1986 Whitham ..... 315/5.41
6,407,505 B1 * 6/2002 Bertsche ..... 315/5.41
6,498,444 B1 * 12/2002 Hanna et al. ..... 315/500
2002/0190670 A1 * 12/2002 Pappo et al. ..... 315/500

OTHER PUBLICATIONS

Karzmark et al., "Microwave Principles for Linacs", Medical Electron Accelerators, McGraw–ill, Inc. 1993.
Karzmark et al., "Microwave Accelerator Structures", Medical Electron Accelerators, McGraw–Hill, Inc. 1993.
Benguang et al., "A Tuning Method for Side Coupled Standing Wave Accelerating Tubes" Clear Instruments and Methods in Physics Research, 1987 North Holland Amsterdam.

* cited by examiner

*Primary Examiner*—Nikita Wells

(57) ABSTRACT

An improved method, system, and apparatus for tuning a particle accelerator is provided which includes tuning side cavities while placing adjancent cavities in a de-tuned condition. A conductor is positioned such that a primary cavity under test is minimally excited, while adjacent side cavities are excited. Coupled modes are measured. The primary cavity is tuned based on the measured coupled modes. According to the invention, this tuning is accomplished without use of access ports to the interior of the side cavities.

20 Claims, 6 Drawing Sheets

METHOD AND APPARATUS FOR TUNING PARTICLE ACCELERATORS

BACKGROUND OF THE INVENTION

1. Field of the Invention

The present invention relates generally to particle accelerators. More particularly, embodiments of the present invention relate to systems and methods for tuning particle accelerators.

2. Description of the Related Art

Particle accelerators have been used for a number of years in various applications. For example, one common and important application is their use in medical radiation therapy devices. In this application, an electron gun is coupled to an input cavity of a linear accelerator. The electron gun provides a source of charged particles to the accelerator. The accelerator then accelerates the charged particles to produce an accelerated output beam of a desired energy for use in medical radiation therapy.

It is important to ensure that the beam output from a particle accelerator is generated efficiently and is of the desired energy. The energy and other characteristics of the beam are dependent upon the resonant frequency of the accelerator which in turn depends upon the shape and manufacture of the accelerator. The operating efficiency of a particle accelerator is optimized when the resonant frequency of the accelerator matches the frequency of the applied driving signal. Although the physical characteristics of the acceclerator needed to achieve the desired resonant frequency may be determined precisely, imperfections in the accelerator cavity structure may result from variations in the accelerator manufacturing process. These imperfections tend to detune the accelerator cavity structure. As a result, accelerators generally must be tuned before they are used for their intended application.

This tuning process is an iterative process that is sequentially performed for each cavity of a particle accelerator until each cavity has been tuned to a desired resonant frequency. Existing tuning processes first require that a cavity to be tuned be isolated from other cavities in the particle accelerator by shorting adjacent cavities. An input signal is then applied to the cavity under test and a resonant frequency of the cavity is measured. A tuning technician typically compares the measured resonant frequency with an expected resonant frequency to determine if the cavity is properly tuned. If the measured resonant frequency is different than the expected resonant frequency, the tuning technician physically deforms the cavity by hitting an exterior surface of the cavity with a hard object, such as a hammer. This process is repeated for each cavity until the particle accelerator is properly tuned. The assignee of the present invention, in co-pending, and commonly-assiged U.S. patent application Ser. No. 09/546,409, filed Apr. 10, 2000 for "COMPUTER-AIDED TUNING OF CHARGED PARTICLE ACCELERATORS" (the contents of which are incorporated in their entirety herein for all purposes) has developed a way to increase the efficiency of tuning such devices with the assistance of computer automation.

Many existing particle accelerators use coupling cavities moved off the beam axis ("side cavities") to provide coupling between primary cavities. Use of these side cavities can complicate the tuning of a particle accelerator. Currently, to tune a primary cavity, adjacent side cavities are decoupled from the primary cavity. The side cavity is typically decoupled (or taken out of resonance with the primary cavity) by placing the side cavity in a de-tuned condition. This condition presently requires use of access ports fabricated into each side cavity. These access ports can also complicate the manufacturing process, making it difficult to fabricate side cavities having desired microwave characteristics. The use of access ports also increases the cost of manufacturing side cavities.

Perhaps more importantly, however, the use of these access ports can result in decreased operating efficiency of the particle accelerator after tuning because the access ports must be sealed after the tuning process has been completed. These access ports are sealed by brazing or welding a metal cap onto the access port after tuning. The high temperatures required to cap the access port can deform the side cavity resulting in a change in the resonant frequency of the cavity. Because the access port is sealed, the side cavity (and thus the particle accelerator) cannot be retuned after sealing. As a result, the overall efficiency of the particle accelerator can be degraded.

Typical tuning methods measure the resonant frequencies of individual cavities by isolating adjacent cavities. In operation, however, operation of a particle accelerator involves the interaction of a number of adjacent cavities in the accelerator. Gu, et al., in "A TUNING METHOD FOR SIDE COUPLED STANDING WAVE ACCELERATING TUBES", Nuclear Instruments and Methods of Physics Research (1987), 339–342, describe a manual tuning technique which measures three coupled modes (involving three cavities, the primary cavity and two side cavities) by resonating the two primary cavities adjacent to the primary cavity under test. While this allows tuning of an accelerator having side cavities formed without access ports, the multiple variables involved require many testing iterations to arrive at a tuned cavity. Further, tuning is complicated because the measured three modes depend heavily on the primary cavity to be tuned. Thus, a substantial number of iterations is needed to converge toward the target frequency.

It would be desirable to provide a tuning method and apparatus which reduces the number of variables affecting the tuning process. Further, it would be desirable to provide a tuning method and apparatus which reduces the amount of manual intervention required, while still allowing use of an accelerator having side cavities without access ports. It would also be desirable to provide a system and method that allows the particle accelerator to be repeatedly tuned after deployment and use.

SUMMARY OF THE INVENTION

To alleviate the problems inherent in the prior art, embodiments of the present invention provide a method, system and apparatus for tuning particle accelerators.

According to one embodiment of the present invention, a method, system, and apparatus for tuning a particle accelerator is provided which includes tuning side cavities while placing adjancent cavities in a de-tuned condition. A conductor is positioned such that a primary cavity under test is minimally excited, while adjacent side cavities are excited. Coupled modes are measured. The primary cavity is tuned based on the measured coupled modes. According to the invention, this tuning is accomplished without use of access ports to the interior of the side cavities.

According to one embodiment, the side cavities are tuned by placing adjacent cavities in a de-tuned condition and measuring a resonant frequency of the side cavity and deforming the side cavity if the measured resonant frequency is not equal to, or within an acceptable range of, an expected resonant frequency for the side cavity.

According to one embodiment, the coupled modes are measured by placing adjacent primary cavities in a de-tuned condition and then operating an analyzer to detect the coupled modes. According to one embodiment, the primary cavity is tuned by calculating a measured resonant frequency of the primary cavity using the measured coupled modes and the measured resonant frequency of the side cavities.

According to one embodiment, some or all of the tuning is performed under the control or direction of a computer. Means for tuning a particle accelerator are also provided.

The present invention is not limited to the disclosed preferred embodiments, however, as those skilled in the art can readily adapt the teachings of the present invention to create other embodiments and applications.

BRIEF DESCRIPTION OF THE DRAWINGS

The exact nature of this invention, as well as its objects and advantages, will become readily apparent from consideration of the following specification as illustrated in the accompanying drawings, in which like reference numerals designate like parts throughout the figures thereof, and wherein.

DETAILED DESCRIPTION

The following description is provided to enable any person skilled in the art to make and use the invention and sets forth the best modes contemplated by the inventor for carrying out the invention. Various modifications, however, will remain readily apparent to those skilled in the art.

A number of terms are used herein to describe features of embodiments of the present invention. As used herein, the term "primary cavity" will be used to refer to cavities in a particle accelerator that are disposed along a beam axis. The term "side cavity" will be used to refer to coupling cavities in a particle accelerator which are moved off the beam axis and which provide side coupling between primary cavities. The term "access port", as used herein, will refer to holes or portals formed in side cavities that are adapted to permit access to the interior of a side cavity. Such access ports were typically used prior to the invention to permit access to decouple side cavities from primary cavities during tuning processes.

Figure 1:
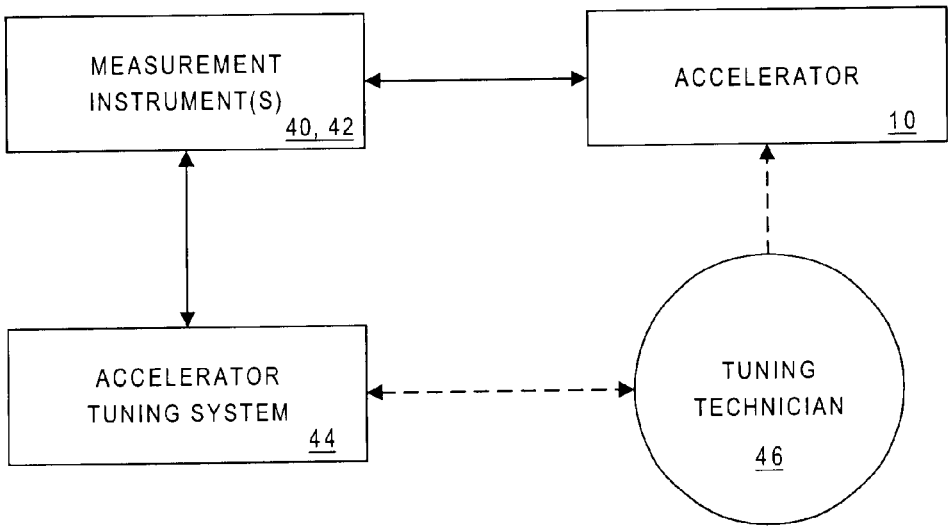
FIG. 1 is block diagram depicting a charged particle accelerator configured for tuning according to embodiments of the present invention.

Referring first to FIG. 1, a block diagram of a standing-wave linear particle accelerator 10 according to one embodiment of the present invention is shown. As depicted in FIG. 1, particle accelerator 10 is configured for tuning pursuant to embodiments of the present invention. Particle accelerator 10 is an elongated structure that includes both an input side and an output side (not shown). In operation, an electron gun (not shown) is typically coupled to an input side of accelerator 10, while an accelerated particle beam is driven out of an output side.

According to embodiments of the present invention, accelerator 10 may be tuned using manual, non-automated techniques, or using automated techniques. As shown in FIG. 1, tuning typically involves a tuning technician 46, measurement instrument(s) 40, 42, and, in some embodiments, an accelerator tuning system 44. Accelerator tuning system 44 may be a computer system which includes input and output devices facilitating interaction with tuning technician 46. Further details regarding use of tuning system 44 and measurement instrument(s) 40, 42 will be provided below. As will be described, embodiments of the present invention allow ready and efficient tuning of particle accelerators, such as the standing-wave linear accelerator 10 of FIG. 1.

Figure 2:
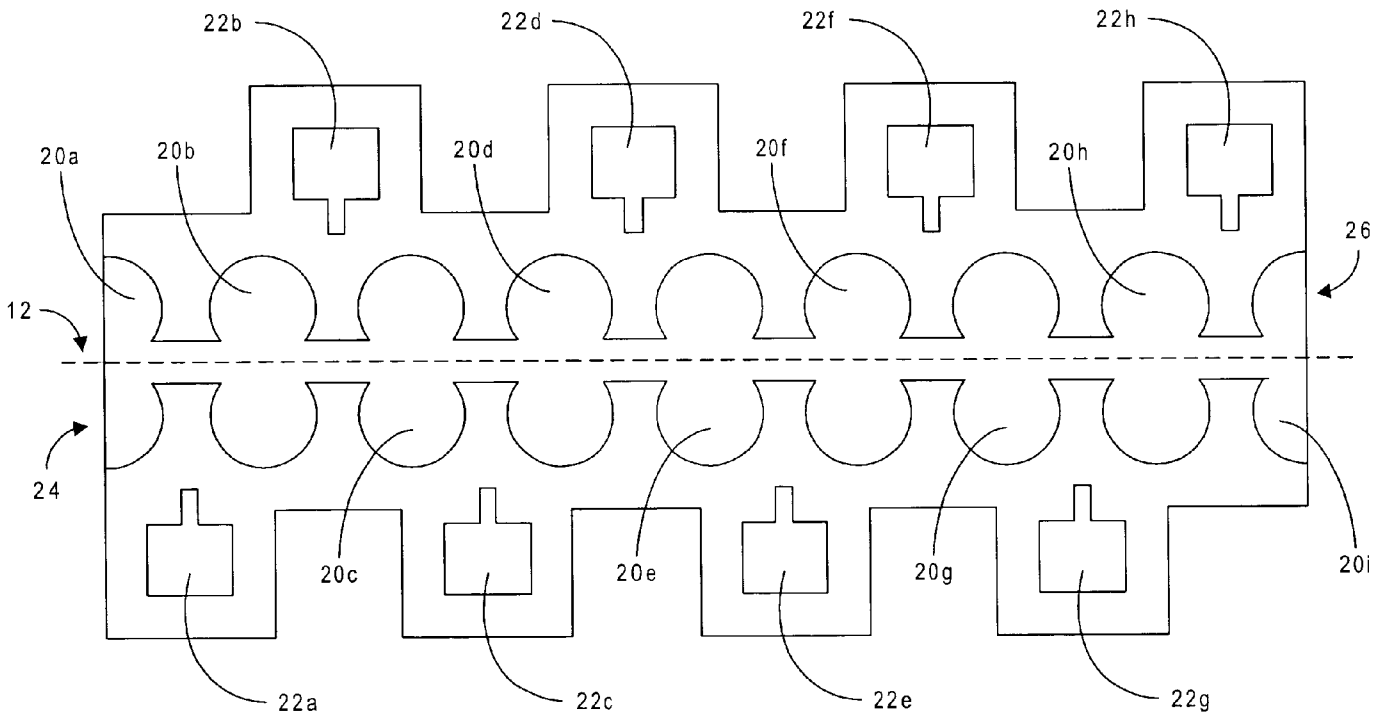
FIG. 2 is a cross-section of the charged particle accelerator of FIG. 1.

Referring now to FIG. 2, a cross-sectional view of one embodiment of a standing-wave linear particle accelerator 10 according to the invention is shown. Accelerator 10 has a plurality of primary cavities 20*a–i* disposed along a beam axis 12 of accelerator 10. These primary cavities 20 are arranged and formed to accelerate particles along beam axis 12. Beam axis 12 defines a path of the charged particle beam through accelerator 10.

A plurality of side cavities 22*a–h* are also provided. Each side cavity is disposed between pairs of primary cavities to provide side coupling between primary cavities. For example, side cavity 22*b* provides coupling between primary cavities 20*b* and 20*c*. The design and arrangement of these cavities is known to those skilled in the art. Charged particles, input into accelerator 10 from an electron gun or injector (not shown) are bunched together in the first few primary cavities. The bunch of charged particles will pass through each successive cavity during a time interval when the electric field intensity in that cavity is a maximum. Preferably, each of the cavities is shaped and tuned such that its resonant frequency ensures that the bunched electrons pass at the peak of intensity of each cavity.

As described above, previous side cavities were commonly formed with access ports to allow tuning. According to one embodiment of the present invention, side cavities 22 are formed without access ports. As will be described herein, embodiments of the present invention permit tuning of accelerators without need for such access ports. According to one embodiment, other than the lack of access ports, side cavities 22 are fabricated in a manner known in the art. For example, each side cavity 22 may be constructed with a coupling iris providing coupling between the side cavity 22 and an adjacent primary cavity 20. The dimensions and construction of these cavities 20, 22 are selected using techniques known in the art.

Figure 3:
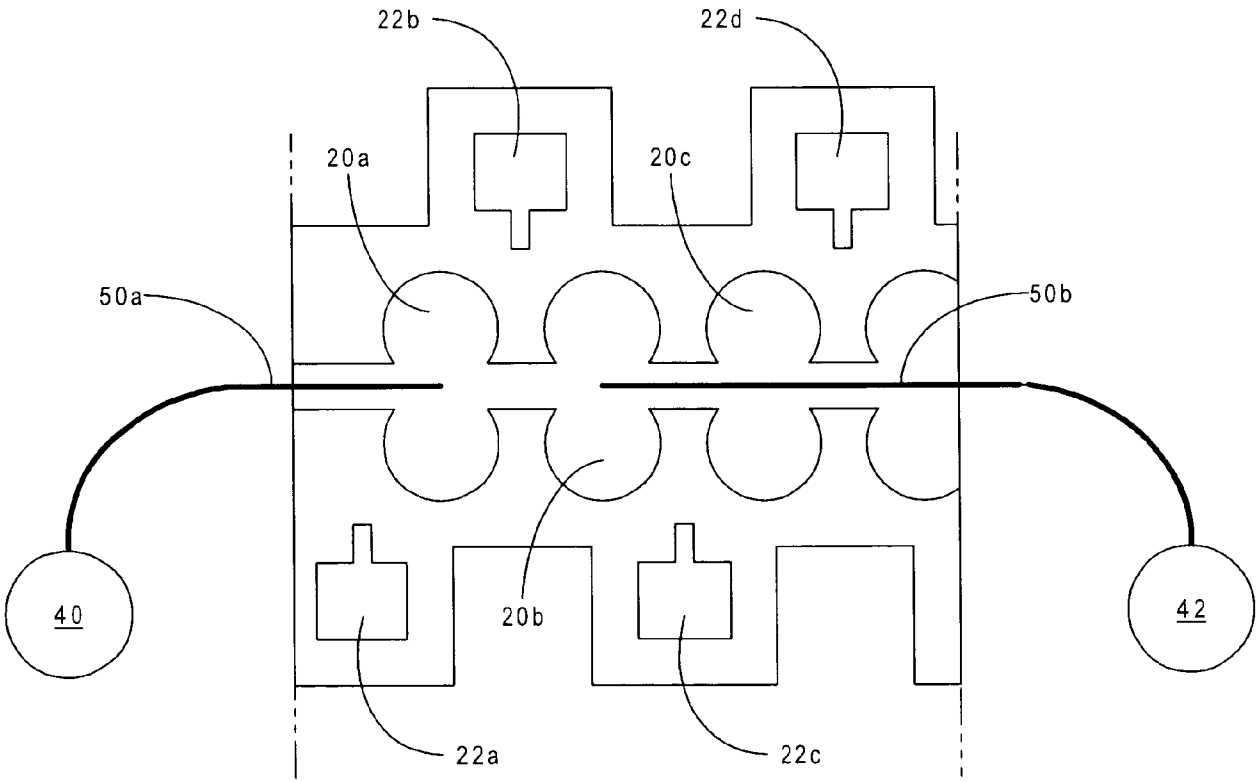
FIG. 3 is a partial cross-section of the charged particle accelerator of FIG. 1.

Referring now to FIG. 3, a partial cross section of accelerator 10 is shown which depicts a layout of components during one step of a tuning process pursuant to embodiments of the invention. As shown in FIG. 3, coaxial conductors formed into two probes 50*a*, 50*b* have been introduced into accelerator 10 along beam axis 12. In FIG. 3, one probe 50*a* has been extended such that it is extended into primary cavity 20*a*, while probe 50*b* is extended into an adjacent primary cavity, primary cavity 20*b*. As a result, cavities 20*a*, 20*b* and other primary cavities in accelerator 10 are placed in a de-tuned condition. The only resonant cavity is side cavity 22*b* (adjacent side cavities 22*a*, 22*c*, are placed in a de-tuned condition). As a result, measurements of the response of side cavity 22*b* may be taken.

In one embodiment, probe 50*a* is coupled to a source 40, such as an oscillator, that generates a signal at a selected frequency (source 40 may be controlled directly by the technician 46 of FIG. 1, or via tuning system 44). This signal is presented to side cavity 22*b* via coaxial conductor 50. The resonant frequency of side cavity 22*b* is then measured (e.g., a resonant frequency ($\omega$) may be measured using an analyzer 42 coupled to probe 50*b*).

Technician 46 (FIG. 1) may then determine if the measured resonant frequency is equal to an expected resonant frequency for the side cavity 22*b*. If the measured frequency is not as expected, the technician may deform side cavity 22*b* by striking an exterior surface of side cavity 22*b*. This process is repeated until the measured resonant frequency for the side cavity is equal to or sufficiently near the expected resonant frequency for the cavity. In some embodiments, this measurement process, and the other measurement processes described herein, may be automated under the control of tuning system 44 (FIG. 1). A desirable approach is described in co-pending, commonly-assigned U.S. patent application Ser. No. 09/546,409 (referenced above). In one embodiment, source 40 and analyzer 42 are configured as a single device providing both an input signal and measuring a response. In one embodiment, accelerator tuning system 44 is configured to controllably position probe 50*a*, 50*b* in desired positions within accelerator 10. For example, accelerator tuning system 44 may automatically, or under the direction of tuning technician 46, move probes 50*a*, 50*b* along beam axis 12 to take measurements within different cavities of accelerator 10.

Once side cavity 22*b* has been tuned to a desired resonant frequency, the process is repeated for other side cavities 22 in accelerator 10. Probes 50*a*, 50*b* are moved accordingly. For each side cavity 22, a measurement of the resonant frequency is taken. For the purposes of describing the present invention, the data recorded includes a resonant frequency ($\omega_2$) for side cavity 22*b*. Resonant frequency measurements for each side cavity 22 will be recorded.

Figure 4:
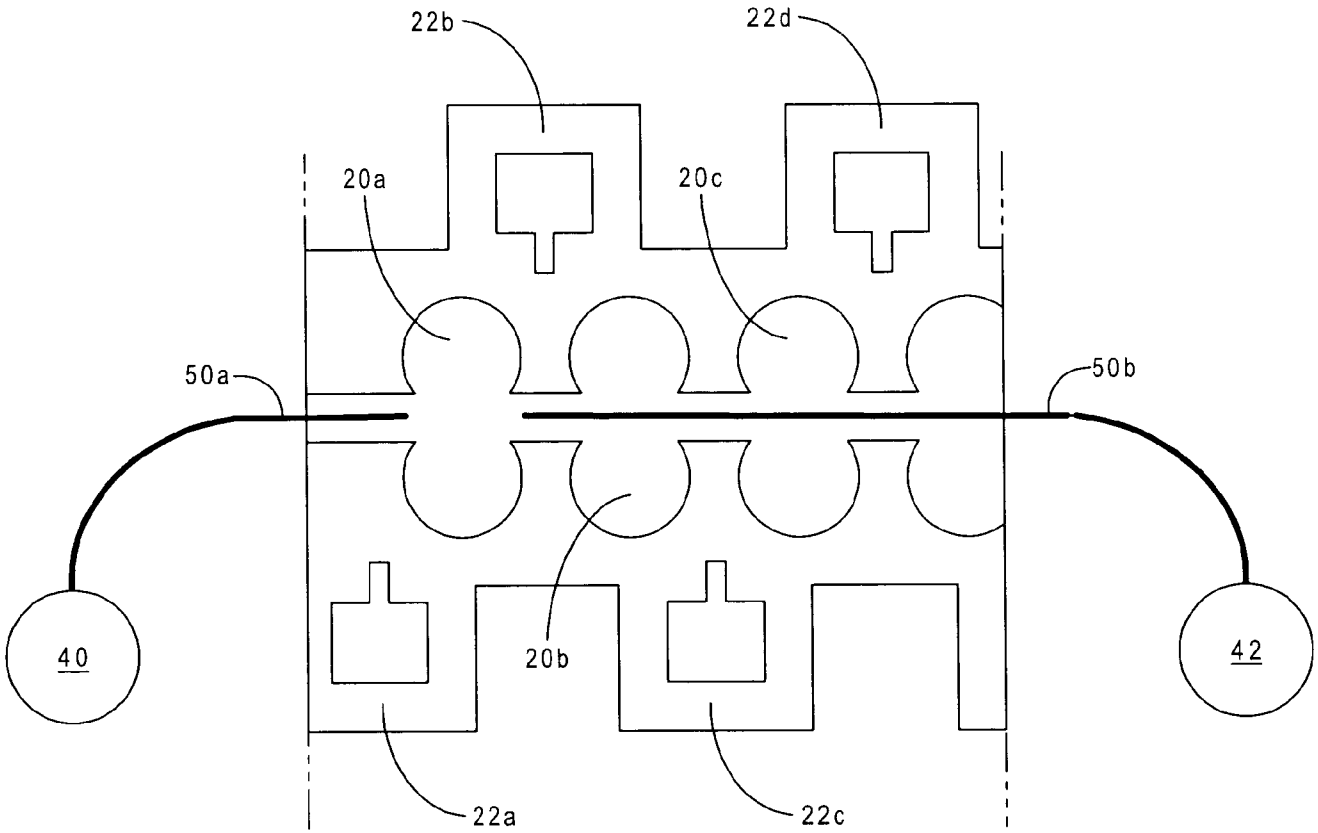
FIG. 4 is a further partial cross-section of the charged particle accelerator of FIG. 1.

Referring now to FIG. 4, another partial cross section of accelerator 10 is shown which depicts a further layout of components during a further step of a tuning process pursuant to embodiments of the invention. As shown in FIG. 4, probes 50*a*, 50*b* have been extended such that all cavities (other than primary cavity 20*a* and adjacent side cavity 22*b*) are shorted. The only resonant cavities are primary cavity 20*a* and its adjacent side cavity 22*b*. According to one embodiment of the present invention, probes 50*a*, 50*b* are positioned such that specific modes can be excited. In particular, in one embodiment, probes 50*a*, 50*b* are preferably positioned such that the primary cavity being tested is not excited (or has a low overall contribution to the coupled modes). Accordingly, measurements may be taken which identify two coupled modes.

As described above, the response of side cavity 22*a* and 22*b* have already been measured and side cavity 22*a* and 22*b* have been tuned to desired resonant frequencies. At this point, according to embodiments of the invention, measurements of the coupled modes ($\Omega_1$, $\Omega_2$) of the three resonating cavities (primary cavity 20*a* and side cavities 22*a*, 22*b*) will be taken. As discussed above, probes 50*a*, 50*b* are been positioned such that two coupled modes are generated.

An input signal is provided from source 40 to primary cavity 20*a* via probe 50*a*. A response is detected on probe 50*b* using analyzer 42. In one embodiment, the response may be monitored using a network analyzer, such as a HP8720 manufactured by Agilent Technologies, Inc., of Palo Alto, Calif. Coupled modes ($\Omega_1$, $\Omega_2$) are detected and measured by analyzer 42.

According to one embodiment of the invention, the measured coupled modes ($\Omega_1$, $\Omega_2$), along with the previously measured resonant frequency ($\omega_2$) of the side cavities are used to solve for the resonant frequency ($\omega_1$) of primary cavity 20*a*. The resonant frequency of the primary cavity may be solved using the following equation:

$$\omega_1=(\omega_2*\Omega_1*\Omega_2)/\mathrm{Sqrt}[(-\Omega_1^2*\Omega_2^2)+(\Omega_1^2*\omega_2^2)+(\Omega_2^2*\omega_2^2)] \quad (1)$$

According to one embodiment of the invention, the calculated resonant frequency ($\omega_1$) of primary cavity 20*a* is compared with an expected resonant frequency. If the calculated resonant frequency is not equal to the expected resonant frequency for that cavity, the technician is directed to attempt to adjust the resonant frequency by deforming an exterior wall of primary cavity 20*a* with a hard object such as a hammer. This process of measuring, calculating and comparing is repeated until the calculated resonant frequency for the cavity is equal (or within an established tolerance of) the expected resonant frequency for the cavity. Once cavity 20*a* has been successfully tuned in this manner, the process is repeated for other primary cavities 20 of accelerator 10. The result is a particle accelerator structure which can be efficiently manufactured and tuned, and which does not suffer from tuning degradation as a result of high temperature welds or brazes used to cap access ports, as side cavity access ports are no longer needed. Further, because the coupled mode of the primary cavity under test is not a big factor in the measurements, tuning may be accomplished more efficiently and with fewer iterations. Embodiments of the present invention also allow further tuning to be performed after deployment or use of the particle accelerator.

Figure 5:
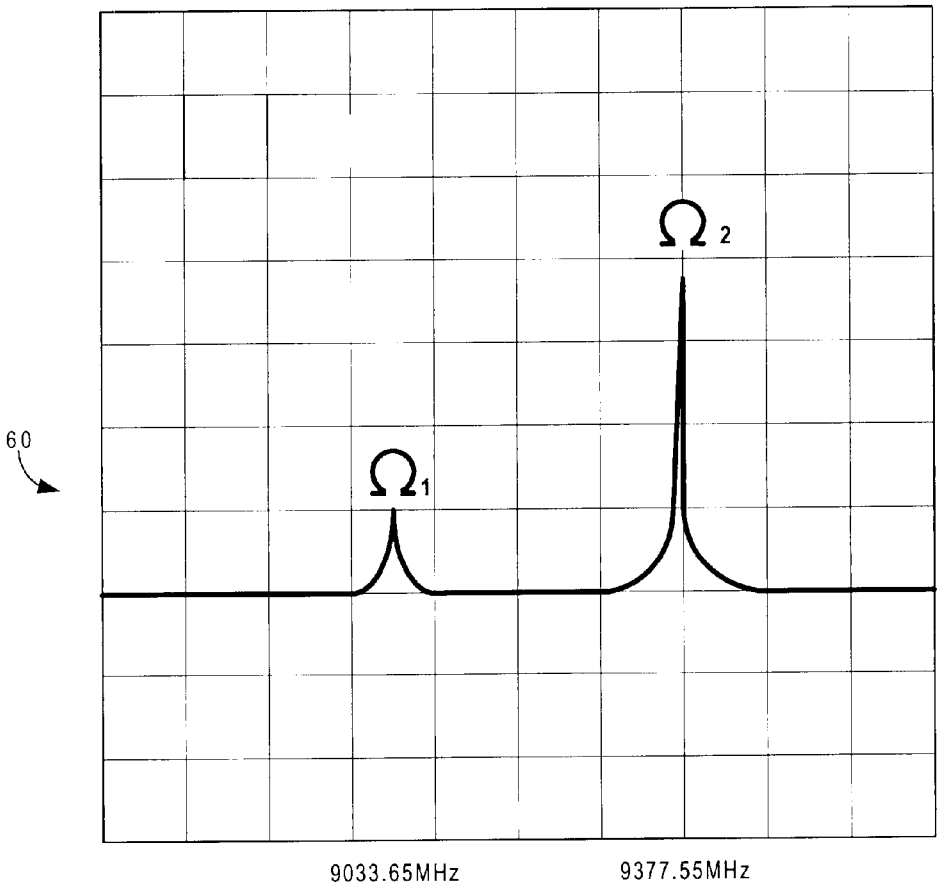
FIG. 5 is an output screen from an analyzer depicting measured coupled modes of chambers of the charged particle accelerator of FIG. 1.

For the purpose of illustrating features of the invention, example data will now be described by referring to FIG. 5, where an example output screen 60 from a network analyzer coupled to receive a signal from probe 50*b* is shown. In the example output screen 60 of FIG. 5, probes 50*a*, 50*b* have been positioned (in one embodiment, under the control of accelerator tuning system 44) such that the primary cavity under test is not excited (or minimally excited). A measurement has been taken from probe 50*b* indicating that two coupled modes ($\omega_1$, $\Omega_2$) have been detected. In the example depicted, $\Omega_1$ is at 9033.65 MHz, while $\Omega_2$ is at 9377.55 MHz. Previously, the resonant frequency $\omega_2$ of side cavity 22*b* was tuned to 9088.9 MHz. Using Formula (1) above, it can be determined that the deduced or calculated resonant frequency for primary cavity 20*a* is 9139 MHz (Applicants, in testing the same configuration, established a measured resonant frequency of 9319.65 MHz). This value can be compared with an expected resonant frequency to determine if primary cavity 20*a* is properly tuned. As described above, in one embodiment, some or all of the processing of the present invention may be performed using an automated system.

Figure 6:
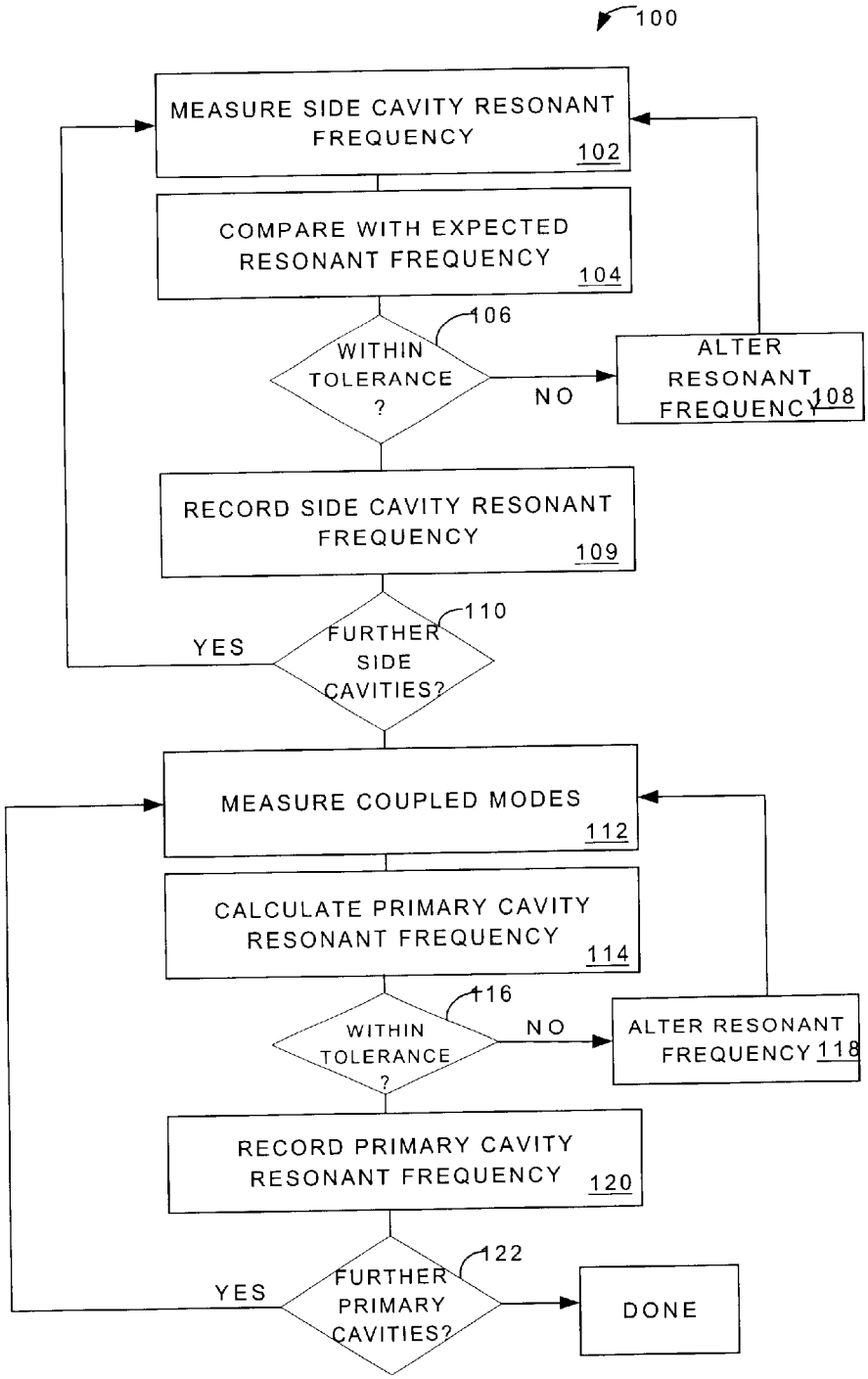
FIG. 6 is a flow diagram of an accelerator tuning method pursuant to embodiments of the present invention.

Referring now to FIG. 6, a tuning process 100 for tuning accelerator 10 is shown. According to one embodiment of the present invention, some or all of the steps of tuning process 100 may be performed under the control of one or more computing devices such as the tuning system 44 of FIG. 1. Tuning process 100 begins at 102 with measuring a resonant frequency of a side cavity. As described above, this includes shorting all adjacent cavities in accelerator 10 by, for example, inserting probes 50*a*, 50*b* into the perimeter of primary cavities 20 adjacent to the side cavity of interest.

Processing continues at 104, where the measured resonant frequency is compared with an expected resonant frequency. If a comparison at 106 indicates that the measured resonant frequency is equal to, or within a desired tolerance of, the expected resonant frequency for the cavity being tuned, processing continues to 109. Otherwise, at 108, a technician or device is instructed to alter the resonant frequency by slightly deforming the cavity being tuned. Processing reverts to 102 where the resonant frequency is again measured. This process repeats until the comparison at 106 indicates that the measured frequency is equal to (or within a tolerance of) an expected resonant frequency.

Processing continues at 109 where the measured resonant frequency of the side cavity is recorded. Processing continues at 110 where a determination is made whether another side cavity exists, and, if so, processing reverts to 102 where the next side cavity is tuned. This process repeats until all side cavities have been tuned, and resonant frequencies for each have been recorded.

Processing continues at 112 where coupled modes are measured. As described above, in one embodiment, this includes positioning probes 50*a*, 50*b* such that the primary cavity of interest is not (or minimally) excited, such that two coupled modes are generated. These coupled modes are measured, for example, using analyzer 42. Processing continues at 114, where the measured resonant frequency of the primary cavity being tuned is calculated (using formula (1) set forth above). That is, the measured resonant frequency is calculated using the measured coupled modes from 112 and from the resonant frequency stored at 108 for the side cavity.

Processing continues at 116 where the measured resonant frequency for the primary cavity is compared with an expected resonant frequency for that cavity. If the measured resonant frequency is equal to, or within an acceptable tolerance of, the expected resonant frequency, processing continues to 120. Otherwise, processing continues to 118 where an operator or device is instructed to deform an exterior of the primary cavity to adjust the resonant frequency. Processing reverts to 112 and the process repeats until the measured resonant frequency is equal to, or within an acceptable tolerance of, the expected resonant frequency of the cavity.

Processing continues at 120 where the resonant frequency of the primary cavity may be recorded for future reference. At 122 a determination is made whether another primary cavity exists, and, if so, processing reverts to 112 where the next primary cavity is tuned. This process repeats until all cavities have been tuned. After tuning, accelerator 10 is ready for use. According to one embodiment of the present invention, accelerator 10 may be re-tuned, even after deployment. Tuning process 100, for example, may be performed after deployment and use by removing a vacuum seal on both ends of the accelerator, allowing introduction of probe 50. Some or all of the steps of tuning process 100 may then be performed to ensure particle accelerator 10 is operating effectively.

According to one embodiment, some or all of the steps of tuning process 100 are performed under the control or direction of a computer. In one embodiment, tuning process 100 is performed under the control or direction of a computer system having one or more processors coupled to one or more input and one or more output devices. The processor may access computer program code stored in one or more storage devices that cause the processor to perform one or more of the steps of tuning process 100.

Although the present invention has been described with respect to a preferred embodiment thereof, those skilled in the art will note that various substitutions may be made to those embodiments described herein without departing from the spirit and scope of the present invention. For example, although use of coaxial conductors formed into probes has been described, those skilled in the art will appreciate that other types of signal cables and shorting devices may be used. Other modifications and substitutions will be apparent to those skilled in the art.

What is claimed is:

1. A method for tuning a particle accelerator, comprising:

tuning a first and a second side cavity while placing adjacent primary cavities in a de-tuned condition;

measuring coupled modes resulting from interaction between said first and second side cavities and said primary cavity; and tuning said primary cavity based on said measured coupled modes.

2. The method of claim 1, wherein each of said side cavities are formed without an access port.

3. The method of claim 1, wherein said tuning said first side cavity comprises:

applying an input signal to said first side cavity while said first and second primary cavities are placed in a de-tuned condition;

measuring a resonant frequency of said first side cavity; and deforming said first side cavity if said measured resonant frequency is not equal to a desired resonant frequency.

4. The method of claim 3, wherein said applying an input signal, measuring a resonant frequency, and deforming said first side cavity are repeated until said measured resonant frequency is equal to said desired resonant frequency.

5. The method of claim 3, wherein said applying an input signal, measuring a resonant frequency, and deforming said first side cavity are repeated until said measured resonant frequency is within an acceptable range of said desired resonant frequency.

6. The method of claim 1, wherein said measuring coupled modes comprises:

positioning a conductor such that said primary cavity is minimally excited while said first and second side cavities are excited; and operating an analyzer to measure said coupled modes.

7. The method of claim 1, wherein said tuning said primary cavity comprises:

calculating a resonant frequency of said primary cavity; and deforming said primary cavity if said calculated resonant frequency is not equal to a desired resonant frequency for said primary cavity.

8. The method of claim 7, wherein said calculating a resonant frequency of said primary cavity comprises calculating the formula $\omega_1=(\omega_2*\Omega_1*\Omega_2)/\mathrm{Sqrt}[(-\Omega_1^2*\Omega_2^2)+(\Omega_1^{2*}\omega_2^2)+(\Omega_2^{2*}\omega_2^2)]$, wherein $\omega_2$ is said measured resonant frequency of said side cavity, and $\Omega_1$ and $\Omega_2$ are said measured coupled modes.

9. The method of claim 7, wherein said measuring coupled modes, calculating a resonant frequency, and deforming are repeated until said calculated resonant frequency is within an acceptable range of said desired resonant frequency.

10. A method for tuning a particle accelerator having a plurality of primary cavities disposed along a beam axis of said particle accelerator and a plurality of side cavities, said side cavities formed without access ports to an interior of said side cavities, the method comprising:

iteratively tuning each of said side cavities while decoupling adjacent cavities, said tuning including measuring a resonant frequency of said side cavity and deforming said side cavity if said measured resonant frequency is not equal to a desired resonant frequency; and iteratively tuning each of said primary cavities while decoupling adjacent primary cavities, said tuning including exciting adjacent side cavities, measuring coupled modes, and calculating a resonant frequency of said primary cavity.

11. The method of claim 10, wherein said calculating a resonant frequency of said primary cavity includes calculating the formula $\omega_1=(\omega_2*\Omega_1*\Omega_2)/\mathrm{Sqrt}[(-\Omega_1^{2}*\Omega_2^{2})+(\Omega_1^{2*}\omega_2^{2})+(\Omega_2^{*2}\omega_2^{2})]$, wherein $\omega_2$ is said measured resonant frequency of said side cavity, and $\Omega_1$ and $\Omega_2$ are said measured coupled modes.

12. A tuning system for a particle accelerator, comprising:

a first and a second primary cavity, disposed along a beam axis;

a coaxial conductor movable along said beam axis through wall openings of said first and second primary cavities to place said second primary cavity in a de-tuned condition and to minimally excite said first primary cavity;

a pair of side cavities, adjacent to said first primary cavity, and excited by said coaxial conductor; and a measurement device, coupled to said coaxial conductor, operative to measure coupled modes of said first primary cavities and said side cavities.

13. The tuning system of claim 12, further comprising:

a signal generator, coupled to said coaxial conductor, operative to selectively excite said cavities.

14. The tuning system of claim 13, wherein said signal generator and said measurement device are formed in a single device.

15. The tuning system of claim 12, further comprising a tuning device coupled to said measurement device, operative to calculate a resonant frequency of said first primary cavity based on a known resonant frequency of said first and second side cavities and said measured coupled modes.

16. The tuning system of claim 15, wherein said tuning device is further operative to compare said calculated resonant frequency to an expected resonant frequency.

17. The tuning system of claim 16, further comprising an output device coupled to said tuning device, operative to generate tuning instructions if said calculated resonant frequency is not equal to said expected resonant frequency.

18. The tuning system of claim 12, further comprising control means, coupled to said coaxial conductor, to selectively position ends of said coaxial conductor along said beam axis.

19. A system for tuning a particle accelerator, comprising:

means for tuning a first and a second side cavity while placing adjacent cavities in a de-tuned condition;

means for positioning a conductor along a beam axis to minimally excite a primary cavity and to excite said first and second side cavities;

a measurement instrument for measuring coupled modes of said primary cavity and said side cavities; and means for tuning said primary cavity based on said measured coupled modes.

20. The system of claim 19, wherein said means for tuning said primary cavity further comprise:

means for calculating a resonant frequency of said primary cavity based on known resonant frequencies of said side cavities and said measured coupled modes;

means for comparing said calculated resonant frequency with an expected resonant frequency for said primary cavity; and means for instructing an operator to deform an exterior of said primary cavity if said calculated resonant frequency is not within an expected tolerance of said expected resonant frequency for said first primary cavity.

* * * * *

UNITED STATES PATENT AND TRADEMARK OFFICE

CERTIFICATE OF CORRECTION

PATENT NO. : 6,674,254 B2
DATED : January 6, 2004
INVENTOR(S) : Hanna et al.

It is certified that error appears in the above-identified patent and that said Letters Patent is hereby corrected as shown below:

Title page,
Item [75], Inventor, should be -- Kenneth Whitham -- not "Kenneth Whitman"

Signed and Sealed this

Sixth Day of April, 2004

JON W. DUDAS
*Acting Director of the United States Patent and Trademark Office*